United States Patent [19]

Brockmanns et al.

[11] Patent Number: 4,557,105

[45] Date of Patent: Dec. 10, 1985

[54] METHOD AND DEVICE FOR PREPARING FIBERS FED TO A FRICTION SPINNING MACHINE

[75] Inventors: Karl-Josef Brockmanns, Anrath; Joachim Lünenschloss, Aachen, both of Fed. Rep. of Germany

[73] Assignee: W. Schlafhorst & Co., Moenchengladbach, Fed. Rep. of Germany

[21] Appl. No.: 643,652

[22] Filed: Aug. 23, 1984

[30] Foreign Application Priority Data

Aug. 23, 1983 [DE] Fed. Rep. of Germany ..... 3330414

[51] Int. Cl.[4] ..... D01H 1/135

[52] U.S. Cl. ..... 57/401; 57/408

[58] Field of Search ..... 57/400, 401, 408, 411, 57/413

[56] References Cited

U.S. PATENT DOCUMENTS 3,636,693 1/1972 Benson et al. ..... 57/401
4,130,983 12/1978 Dammann et al. ..... 57/401 X
4,165,600 8/1979 Schippers et al. ..... 57/401
4,281,507 8/1981 Didek et al. ..... 57/401
4,348,859 9/1982 Olsson ..... 57/401

*Primary Examiner*—Donald Watkins
*Attorney, Agent, or Firm*—Herbert L. Lerner; Laurence A. Greenberg; Adam A. Jorgensen

[57] ABSTRACT

Method of preparing fibers fed from a fiber-loosening device into a wedge-shaped spinning zone of a friction spinning machine having friction elements moveable relative to one another, which includes feeding a fiber-laden carrier-air flow having a component directed parallel to the wedge-shaped spinning zone tangentially to one of the friction elements at a location outside the wedge-shaped spinning zone and in a direction opposite the direction of movement of the one friction element, simultaneously exerting holding forces on the fibers and flinging the fibers against the moving surface of the one friction element so that the fibers are stretched out and held fast thereon, conveying the fibers in held-fast condition thereof into the wedge-shaped spinning zone, rolling the fibers therein and integrating the fibers into a yearn, and drawing-off the thus-formed yarn.

6 Claims, 2 Drawing Figures

METHOD AND DEVICE FOR PREPARING FIBERS FED TO A FRICTION SPINNING MACHINE

Figure 1:
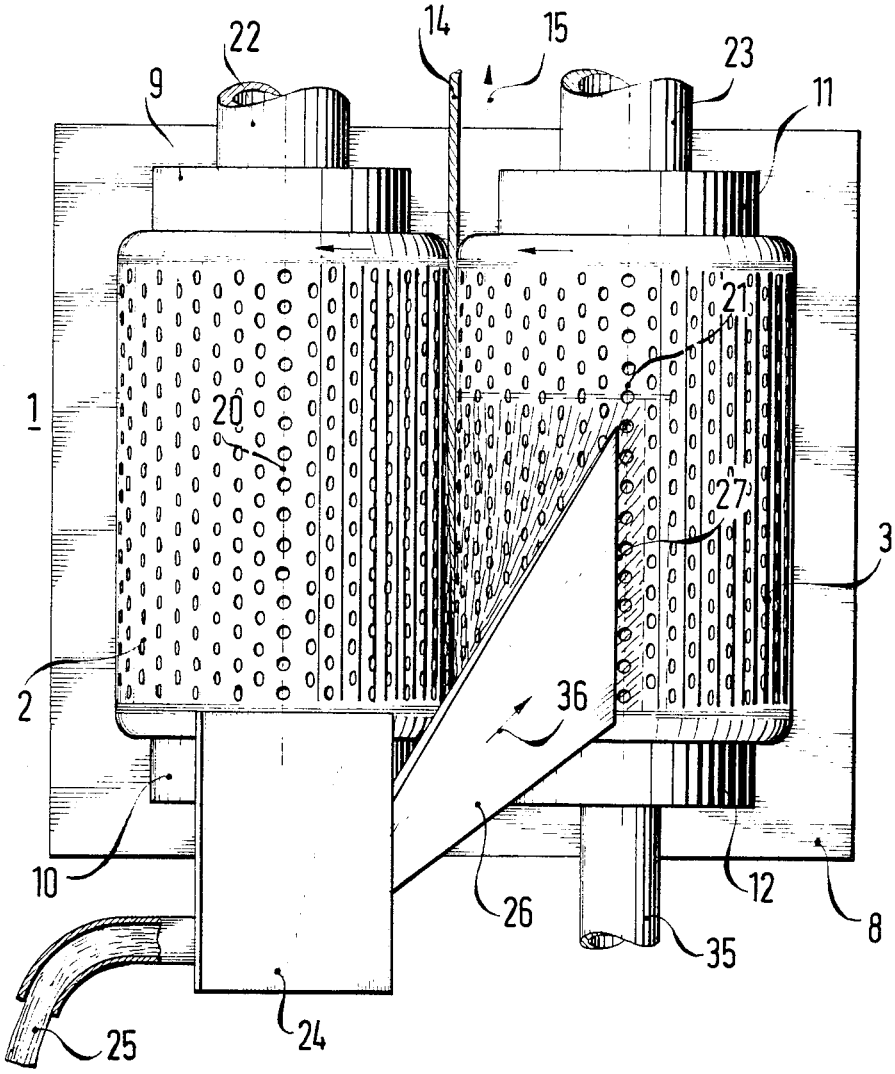

The invention relates to a method and device for preparing fibers fed from a fiber-loosening device into a wedge-shaped space to a spinning zone of a friction spinning machine provided with friction elements which are moveable relative to one another.

In friction spinning machines, the fibers are fed either into the triangular or wedged-shaped space or onto the surface of a friction element. In both cases, the fibers cannot be successfully transferred into the spinning zone in a straightened or stretched out condition, and therefore the structure of the yarn is unsatisfactory.

It is accordingly an object of the invention to provide a method and device for preparing the fibers which avoids this disadvantage and which improves the yarn structure.

With the foregoing and other objects in view, there is provided in accordance with the invention, a method of preparing fibers fed from a fiber-loosening device into a wedge-shaped spinning zone of a friction spinning machine having friction elements moveable relative to one another, which includes feeding a fiber-laden carrier-air flow having a component directed parallel to the wedge-shaped spinning zone tangentially to one of the friction elements at a location outside the wedge-shaped spinning zone and in a direction opposite the direction of movement of the one friction element, simultaneously exerting holding forces on the fibers and flinging the fibers against the moving surface of the one friction element so that the fibers are stretched out and held fast thereon, conveying the fibers in held-fast condition thereof into the wedge-shaped spinning zone, rolling the fibers therein and integrating the fibers into a yearn, and drawing-off the thus-formed yarn.

The spinning fibers in the carrier-air flow have a relatively high velocity. There is no assurance, however, that the fibers carried in the carrier-air flow will assume a straightened-out position, or will, at least to some extent, be straightened out. The surface of the friction element moves in a direction which is opposite to the direction of movement of the fibers, with a component parallel to the triangular or wedge-shaped space, and preferably in the direction in which the yarn moves as it is withdrawing. Because fiber-holding forces are applied from the friction element, each individual fiber is at first held at some location thereof by the friction element and entrained by the latter. The location thereof can be the end of the fiber, but also any other location of the fiber, if the individual fiber in the carrier-air flow assumes a hair-pin-shaped position.

After the end of a fiber or another location of the fiber has become fixed, so to speak, on the surface of the friction elements, the kinetic energy of the fiber causes the end or ends of the fiber to be flung or hurled at an inclined angle with respect to the direction in which the friction element moves. In this regard, the fiber is straightened out and remains attached, as it were, in this straightened-out condition, to the surface of the friction element. Because all of the fibers are subjected to the same kind of preparation, a layer of stretched or straightened-out parallel fibers is formed on the surface of the friction element. In this straightened-out and parallelized condition, the fibers are conveyed to the triangular or wedge-shaped space where they are rolled and combined into a yarn which is withdrawn continuously. A result thereof is a striking improvement in the yarn structure, which would not have been possible to achieve by techniques currently available, without having recourse to the specific method of this invention.

In accordance with another aspect of the invention, there is provided a device for preparing fibers fed from a fiber-loosening device into a wedge-shaped space to a spinning zone of a friction spinning machine having friction elements moveable relative to one another, includes a feed channel for feeding a fiber-laden carrier-air flow having a component directed parallel to the wedge-shaped space out of an open mouth of the feed channel tangentially to one of the friction elements at a feed location outside of the wedge-shaped space and in a direction opposite the direction of movement of the one friction element, the one friction element having means for holding the fibers fast on the surface of the one friction element and for simultaneously conveying the fibers along the wedge-shaped space to the spinning zone.

The means for holding the fibers fast may have quite different forms. Thus, in accordance with a further feature of the invention, the one friction element has a casing formed with perforations, and the means for holding and simultaneously conveying the fibers include a vacuum chamber having a suction opening directed from the interior of the one friction element towards the casing thereof formed with the perforations, the suction opening extending from the feed location along the wedge-shaped space to the spinning zone.

The vacuum prevailing in the vacuum chamber acts on the fibers through the perforations, this action thus causing the fibers to be deposited on the surface of the casing.

In accordance with an added feature of the invention, there is provided fiber aligning lips disposed in the vacuum chamber and extending transversely to the direction of movement of the one friction element. The fibers lying on the surface of the friction element tend to align themselves parallel to the fiber aligning lips. They are forces to do so by the directed air flow at the fiber aligning lip.

In accordance with an additional feature of the invention, the fiber aligning lips are formed as strips having an edge thereof respectively extending at a slight spacing from the casing. In this arrangement, there is no contact between the fiber aligning lips and the friction element. Therefore, no frictional losses can arise and no fibers can be clamped between the fiber aligning lip and the casing of the friction element.

In a friction spinning machine which is provided with pneumatic means for yarn formation, it is of advantage in accordance with a concomitant feature of the invention, the friction elements are connected to a first suction-air source for directing suction air to the spinning zone at the wedge-shaped space, and including a second suction-air source independent of the first suction-air source, the vacuum chamber being connected to the second suction-air source.

Other features which are considered as characteristic for the invention are set forth in the appended claims.

Although the invention is illustrated and described herein as embodied in method and device for preparing fibers fed to a friction spinning machine, it is nevertheless not intended to be limited to the details shown, since various modifications and structural changes may be made therein without departing from the spirit of the invention and within the scope and range of equivalents of the claims.

Figure 2:
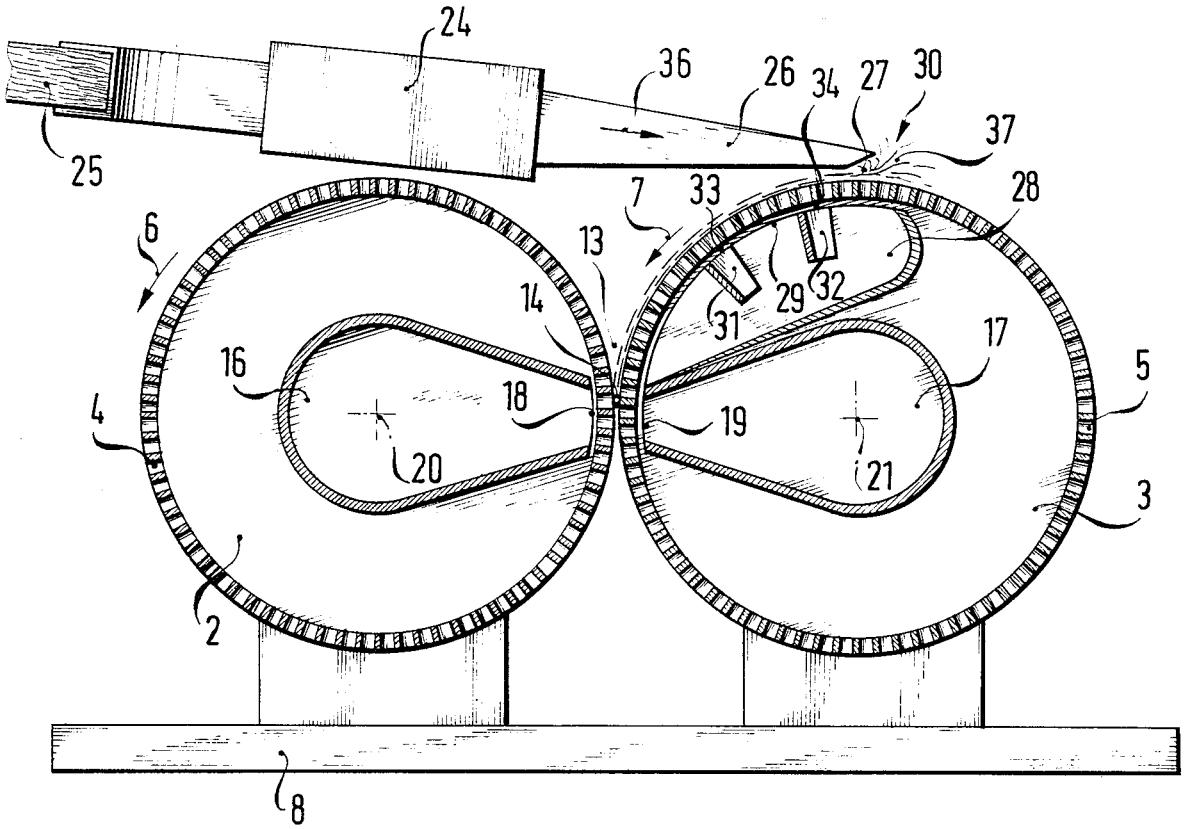

The construction and method of operation of the invention, however, together with additional objects and advantages thereof will be best understood from the following description of specific embodiments when read in connection with the accompanying drawing, in which:

FIG. 1 is a diagrammatic plan view of a friction spinning machine according to the invention; and FIG. 2 is a slightly enlarged elevational view of FIG. 1 as seen from the left-hand side thereof, friction elements of the machine being shown in cross section.

Referring now to the figures of the drawing, there is shown therein a friction spinning machine 1 formed of juxtaposed rotationally-symmetrical friction elements 2 and 3 which rotate in the same direction. As can be seen from FIG. 2, cylindrical casings 4 and 5, respectively, of the friction elements 2 are perforated. The casings 4 and 5 move in the same direction, and this direction is shown by the curved arrows 6 and 7. The friction elements 2 and 3 are supported on a base plate 8. Roller bearings 9 and 10 ensure the rotation of the friction elements 2, and roller bearings 11 and 12 ensure the rotation of the friction element 3. Details of the drive are not illustrated in the drawing since the specific construction thereof is not essential to the invention.

Because the friction elements 2 and 3 are arranged with the axes thereof in parallel, they form a straight line of closest mutual proximity. Above the line of closest mutual proximity, a wedge-shaped or triangular space 13, as shown in FIG. 2, is formed which is defined by the surfaces of the casings 4 and 5. The yarn 14 is formed in the wedge-shaped zone 13 and is drawn off continuously in the direction of the arrow 15 (FIG. 1).

The friction elements 2 and 3 have stationary suction devices 16 and 17 in the interior thereof with suction openings which are directed towards the perforated casings. The friction elements 2 contains the suction device 16 with a slit-shaped suction opening 18 which is directed towards the bottom part of the triangular or wedge-shaped zone 13 and extends parallel to the axis of rotation 20 of the friction element 2. The friction element 3 contains the suction device 17 with a slit-shaped suction opening 19 which is likewise directed towards the bottom part of the triangular or wedge-shaped zone 13 and extends parallel to the rotational axis 21 of the friction element 3. The suction device 16 is connected via a pipeline 22, and the suction device 17 via a pipeline 23, to a common source of suction air.

Fibers needed for the formation of the yarn 14 are supplied from a fiber-loosening or separating device 24. In the fiber-loosening device 24, there revolves a toothed loosening roller, which loosens or separates the strand of fibers 25 fed to it, into individual fibers which are conveyed, via a fiber feed channel 26 traversed by carrier air and fibers, to the friction element 3. The fiber feed channel 26 is provided with an open mouth 27 which is situated outside the spinning zone of the wedge-shaped space 13 and extends parallel to the axis of rotation 21 of the friction element 3. The fiber feed channel 26 is arranged so that the fiber feed therein or a component thereof is in opposite direction to that in which the friction element 3 moves, and is directed parallel to the wedge-shaped zone 13 and tangential to the friction element 3, as can be seen from FIG. 2 of the drawing. The friction element 3 per se has means for holding the fibers on the surface thereof and for conveying the fibers at the same time to the wedge-shaped zone 13. These holding means are formed of a vacuum chamber 28 having a suction opening 29 directed towards the perforated casing 5 from below, or within the friction element 3. The suction opening 29 extends from the fiber feeding location 30 to the spinning zone which is situated in the triangular or wedge-shaped space 13 and in which the yarn 14 is formed.

Inside the vacuum chamber 28, and transversely to the direction 7 in which the friction element 3 moves, there are fiber aligning lips which are shaped like strips 31 and 32, respectively. The strips 31 and 32 are slightly inclined to the longitudinal direction of the friction element 3. The edge 33 and 34, respectively, of these strips 31 and 32 are arranged slightly spaced from the casing 5 of the friction element 3.

The vacuum chamber 28 is connected via a pipeline 35 to its own source of suction air which is independent of the supply of suction air for the friction elements 2, 3. The source of suction air for the pipeline 35 is not shown in the drawing. The vacuum pressure and the air volume of suction air or the flow rate thereof, respectively, are adjustable.

A flow of carrier air containing fibers traverses or flows through the fiber feed channel 26 in the direction shown by the arrow 36 which is opposed to the direction 7 of rotation of of the friction element 3, thus with a component directed parallel to the triangular or wedge-shaped space 13. The flow of carrier air containing the fibers is fed tangentially to the friction elements 3 outside the spinning zone, fiber holding forces being simultaneously exerted by the friction element 3 due to the suction air flowing into the vacuum chamber 28 through the perforations formed in the surface 5. As can be seen in FIG. 2, the fibers 37 issuing from the mouth 27 of the channel 26 are propelled or hurled against the moving surface of the friction element 3 and, in this regard, are initially held at one end or at another location of the friction element 3 and, due to the yet effective kinetic energy, are stretched or straightened out and subsequently held fast along the entire length thereof. FIG. 1 gives a general impression of the disposition of the fibers while they are in the held-fast condition. Most of the fibers are arranged stretched out at an inclined angle to the draw-off direction 15 of the yarn 14. Resembling a loose fleece of fibers, most of which are oriented in the same direction, the fiber material is conveyed to the spinning zone, where the fibers are rolled into the form of the yarn 14.

The carrier-air flow can be produced by the fiber loosening or separating device 24 and it can also be produced by the vacuum prevailing in the vacuum chamber 28, or by both together, to mention only a few examples.

As mentioned hereinbefore, the invention is not confined to the embodiment thereof shown and described herein. The position of the strips 31 and 32 and the spacing thereof from the casing 5 of the friction element 3 is a matter of choice and can, alternatively also be adjustable, so that the best possible spinning results can be achieved in all cases, whatever the particular circumstances may be.

The foregoing is a description corresponding, in substance, to German application No. P 33 30 414.9, dated Aug. 23, International priority of which is being claimed for the instant application, and which is hereby made part of this application. Any material discrepancies between the foregoing specification and the specification of the aforementioned corresponding German application are to be resolved in favor of the latter.

There are claimed:

1. Method of preparing fibers fed from a fiber-loosening device into a wedge-shaped spinning zone of a friction spinning machine having friction elements moveable relative to one another, which comprises feeding a fiber-laden carrier-air flow having a component directed parallel to the wedge-shaped spinning zone tangentially to one of the friction elements at a location outside the wedge-shaped spinning zone and in a direction opposite the direction of movement of the one friction element, simultaneously exerting holding forces on the fibers and flinging the fibers against the moving surface of the one friction element so that the fibers are stretched out and held fast thereon, conveying the fibers in held-fast condition thereof into the wedge-shaped spinning zone, rolling the fibers therein and integrating the fibers into a yarn, and drawing-off the thus-formed yarn.

2. Device for preparing fibers fed from a fiber-loosening device into a wedge-shaped space to a spinning zone of a friction spinning machine having friction elements moveable relative to one another, comprising a feed channel for feeding a fiber-laden carrier-air flow having a component directed parallel to the wedge-shaped space out of an open mouth of said feed channel tangentially to one of the friction elements at a feed location outside of the wedge-shaped space and in a direction opposite the direction of movement of the one friction element, the one friction element having means for holding the fibers fast on the surface of the one friction element and for simultaneously conveying the fibers along the wedge-shaped space to the spinning zone.

3. Device according to claim 2 wherein the one friction element has a casing formed with perforations, and said means for holding and simultaneously conveying the fibers comprise a vacuum chamber having a suction opening directed from the interior of the one friction element towards said casing thereof formed with said perforations, said suction opening extending from said feed location along the wedge-shaped space to the spinning zone.

4. Device according to claim 3 including fiber aligning lips disposed in said vacuum chamber and extending transversely to the direction of movement of the one friction element.

5. Device according to claim 4 wherein said fiber aligning lips are formed as strips having an edge thereof respectively extending at a slight spacing from said casing.

6. Device according to claim 3 wherein the friction elements are connected to a first suction-air source for directing suction air to the spinning zone at the wedge-shaped space, and including a second suction-air source independent of the first suction-air source, said vacuum chamber being connected to said second suction-air source.

* * * * *